US007931127B2

(12) United States Patent
Kondo et al.

(10) Patent No.: US 7,931,127 B2
(45) Date of Patent: Apr. 26, 2011

(54) ELEVATOR APPARATUS

(75) Inventors: Rikio Kondo, Tokyo (JP); Hiroshi Kigawa, Tokyo (JP); Takaharu Ueda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 581 days.

(21) Appl. No.: 11/908,851

(22) PCT Filed: Aug. 3, 2006

(86) PCT No.: PCT/JP2006/315393

§ 371 (c)(1),
(2), (4) Date: Sep. 17, 2007

(87) PCT Pub. No.: WO2008/015749

PCT Pub. Date: Feb. 7, 2008

(65) Prior Publication Data

US 2009/0229924 A1 Sep. 17, 2009

(51) Int. Cl.
*B66B 1/32* (2006.01)

(52) U.S. Cl. ..... 187/288; 187/277; 187/313

(58) Field of Classification Search ..... 187/277, 187/288, 313

See application file for complete search history.

(56) References Cited

U.S. PATENT DOCUMENTS

| | | | | |
|---|---|---|---|---|
| 4,220,222 | A | 9/1980 | Kamaike et al. | |
| 5,070,290 | A * | 12/1991 | Iwasa et al. | 318/758 |
| 5,244,060 | A * | 9/1993 | Tanaka et al. | 187/261 |
| 5,323,878 | A * | 6/1994 | Nakamura et al. | 187/264 |
| 5,402,863 | A * | 4/1995 | Okumura et al. | 187/288 |
| 6,802,395 | B1 * | 10/2004 | Helstrom et al. | 187/288 |

FOREIGN PATENT DOCUMENTS

| | | |
|---|---|---|
| CN | 1486918 | 4/2004 |
| GB | 2 153 465 | 8/1985 |
| JP | 54-33454 | 3/1979 |
| JP | 60-148879 | 8/1985 |
| JP | 7 157211 | 6/1995 |
| JP | 7 206288 | 8/1995 |
| KR | 1993-422 | 1/1993 |

OTHER PUBLICATIONS

U.S. Appl. No. 12/064,394, filed Feb. 21, 2008, Ueda, et al.*
U.S. Appl. No. 12/064,910, filed Feb. 26, 2008, Kondo, et al.*
U.S. Appl. No. 12/532,414, filed Sep. 22, 2009, Ueda, et al.
U.S. Appl. No. 12/740,371, Apr. 29, 2010, Kondo, et al.
U.S. Appl. No. 12/810,313, filed Jun. 24, 2010, Kondo, et al.
U.S. Appl. No. 12/812,609, filed Jul. 13, 2010, Ueda.

* cited by examiner

*Primary Examiner* — Walter Benson
*Assistant Examiner* — Kawing Chan
(74) *Attorney, Agent, or Firm* — Oblon, Spivak, McClelland, Maier & Neustadt, L.L.P.

(57) ABSTRACT

In an elevator apparatus, a brake device is controlled by a brake control device. The brake control device is capable of performing braking force reduction control for reducing the braking force of the brake device at a time of emergency braking of a car. The brake control device monitors a running state of the car at the time of emergency braking thereof, and makes a switchover between validity and invalidity of braking force reduction control such that the car is stopped within a preset allowable stopping distance.

13 Claims, 6 Drawing Sheets

ELEVATOR APPARATUS

TECHNICAL FIELD

The present invention relates to an elevator apparatus having a brake control device capable of controlling a braking force at the time of emergency braking.

BACKGROUND ART

In a conventional elevator apparatus, at the time of emergency stop, the current supplied to a brake coil is controlled to variably control the deceleration of a car. At the time of emergency stop, a speed command based on an emergency stop speed reference pattern having a predetermined deceleration is output from a speed reference generating portion (e.g., see Patent Document 1).

Patent Document 1: JP 07-206288 A

DISCLOSURE OF THE INVENTION

Problem to be Solved by the Invention

In the conventional elevator apparatus structured as described above, changes in stopping distance in controlling the deceleration of the car at the time of emergency stop are not taken into account. Therefore, for example, should the error from the speed reference pattern increase or should the function of control itself fail to be activated properly, there would be an apprehension that the stopping distance may exceed an allowable stopping distance and that the car may plunge into each of terminal portions of a hoistway.

The present invention has been made to solve the above-mentioned problem, and it is therefore an object of the present invention to provide an elevator apparatus capable of more reliably keeping a car from reaching each of terminal portions of a hoistway while preventing the car from undergoing an excessively high deceleration at the time of emergency braking.

Means for Solving the Problem

An elevator apparatus according to the present invention includes: a car; a brake device for braking running of the car; and a brake control device for controlling the brake device, the brake control device being capable of performing braking force reduction control for reducing a braking force of the brake device at a time of emergency braking of the car, in which the brake control device monitors a running state of the car at the time of emergency braking of the car, and makes a switchover between validity and invalidity of the braking force reduction control such that the car is stopped within a preset allowable stopping distance.

BEST MODES FOR CARRYING OUT THE INVENTION

Preferred embodiments of the present invention will be described hereinafter with reference to the drawings.

Embodiment 1

Figure 1:
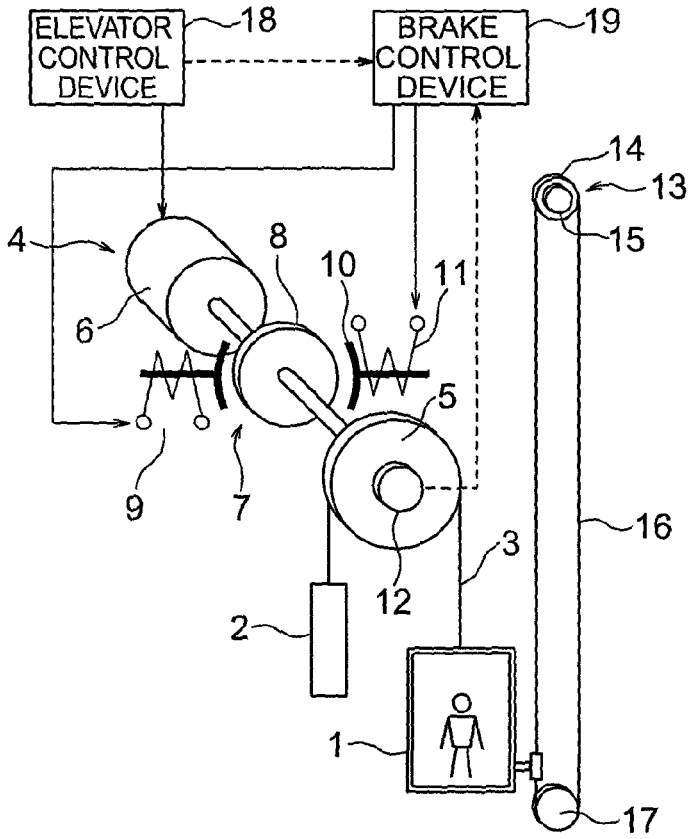
FIG. 1 is a schematic diagram showing an elevator apparatus according to Embodiment 1 of the present invention.

FIG. 1 is a schematic diagram showing an elevator apparatus according to Embodiment 1 of the present invention. Referring to FIG. 1, a car 1 and a counterweight 2 are suspended within a hoistway by a main rope (suspension means) 3 to be raised/lowered within the hoistway due to a driving force of a hoisting machine 4. The hoisting machine 4 has a drive sheave 5 around which the main rope 3 is looped, a motor 6 for rotating the drive sheave 5, and braking means 7 for braking rotation of the drive sheave 5.

The braking means 7 has a brake pulley 8 that is rotated integrally with the drive sheave 5, and a brake device 9 for braking rotation of the brake pulley 8. A brake drum, a brake disc, or the like is employed as the brake pulley 8. The drive sheave 5, the motor 6, and the brake pulley 8 are provided coaxially.

The brake device 9 has a plurality of brake shoes 10 that are moved into contact with and away from the brake pulley 8, a plurality of brake springs for pressing the brake shoes 10 against the brake pulley 8, and a plurality of electromagnets for opening the brake shoes 10 away from the brake pulley 8 against the brake springs. The electromagnets have brake coils (electromagnetic coils) 11. Each of the brake coils 11 is excited by being supplied with a current.

By causing a current to flow through the respective brake coils 11, the electromagnets are excited, so an electromagnetic force for canceling a braking force of the brake device 9 is generated. As a result, the brake shoes 10 are opened away from the brake pulley 8. By shutting off the supply of the current to the respective brake coils 11, the electromagnets are stopped from being excited. As a result, the brake shoes 10 are pressed against the brake pulley 8 due to spring forces of the brake springs. In addition, the degree of opening of the brake device 9 can be controlled by controlling the value of the current flowing through the brake coils 11.

The motor 6 is provided with a hoisting machine encoder 12 as a speed detector for generating a signal corresponding to a rotational speed of a rotary shaft of the motor 6, namely, a rotational speed of the drive sheave 5.

A speed governor 13 is installed in an upper portion of the hoistway. The speed governor 13 has a speed governor sheave 14, and a speed governor encoder 15 for generating a signal corresponding to a rotational speed of the speed governor sheave 14. A speed governor rope 16 is looped around the speed governor sheave 14. The speed governor rope 16 is connected at both ends thereof to an operation mechanism of a safety gear mounted on the car 1. The speed governor rope 16 is looped at the lower end thereof around a tension pulley 17 disposed in a lower portion of the hoistway.

The driving of the hoisting machine 4 is controlled by an elevator control device 18. In other words, the raising/lowering of the car 1 is controlled by the elevator control device 18. The brake device 9 is controlled by a brake control device 19. Signals from the elevator control device 18 and the hoisting machine encoder 12 are input to the brake control device 19.

Figure 2:
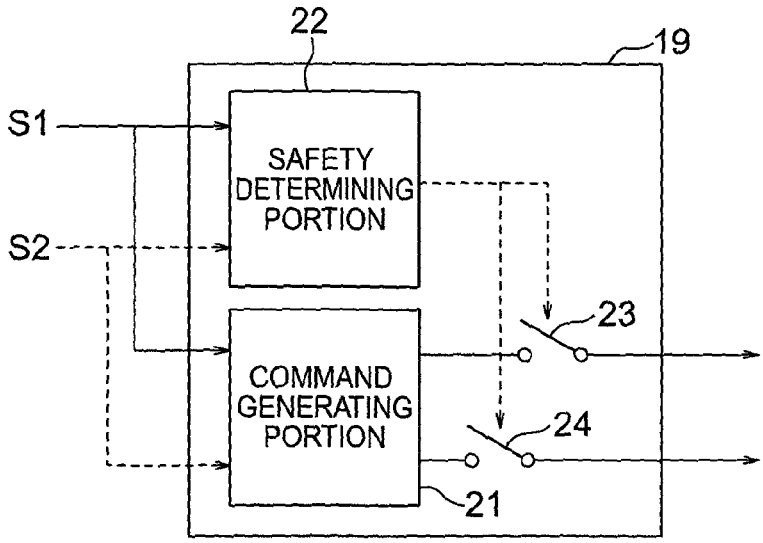
FIG. 2 is a block diagram showing a brake control device of FIG. 1.

FIG. 2 is a block diagram showing the brake control device 19 of FIG. 1. The brake control device 19 has a command generating portion 21, a safety determining portion 22, a first safety relay 23, and a second safety relay 24.

The command generating portion 21 determines whether or not the brake device 9 is in an emergency braking state, based on a signal S1 from the elevator control device 18. Also, the command generating portion 21 detects (calculates) a speed of the car 1 and a deceleration of the car 1 based on a signal S2 from the hoisting machine encoder 12. In addition, when the brake device 9 is in the emergency braking state, the command generating portion 21 generates a command to be given to the brake device 9 in accordance with the deceleration of the car 1 (or speed of car 1). That is, the brake control device 19 can perform braking force reduction control for reducing the braking force of the brake device 9 to prevent the car 1 from undergoing an excessively high deceleration at the time of emergency braking.

The safety determining portion 22 determines whether or not the brake device 9 is in the emergency braking state, based on the signal S1 from the elevator control device 18. Also, the safety determining portion 22 monitors a running state of the car 1 based on the signal S2 from the hoisting machine encoder 12 at the time of emergency braking, and makes a switchover between validity and invalidity of braking force reduction control such that the car 1 is stopped within a preset allowable stopping distance. In Embodiment 1 of the present invention, the safety determining portion 22 detects and monitors the deceleration of the car 1 as the running state of the car 1.

The opening/closing of the first safety relay 23 and the second safety relay 24 is controlled by the safety determining portion 22. The first safety relay 23 and the second safety relay 24 are opened/closed in synchronization with each other. Braking force reduction control performed by the command generating portion 21 is validated through the closure of the first safety relay 23 and the second safety relay 24. When braking force reduction control is valid, a brake command or a brake release command is selectively output to the brake coils 11 in accordance with the deceleration of the car 1 (or speed of car 1). The first safety relay 23 and the second safety relay 24 correspond to the two brake coils 11 of FIG. 1, respectively.

The brake release command during braking force reduction control at the time of emergency braking is not intended to release the brake device 9 completely but to reduce the braking force exerted by the brake device 9 to some extent. More specifically, the braking force for decelerating the brake pulley 8 is controlled by turning a switch for applying a voltage to the brake coils 11 ON/OFF with a predetermined switching duty.

Braking force reduction control performed by the command generating portion 21 is invalidated through the opening of the first safety relay 23 and the second safety relay 24. When braking force reduction control is invalid, the supply of a current to the respective brake coils 11 is shut off regardless of a calculation result in the command generating portion 21, so a total braking force is applied to the brake pulley 8.

When it is determined that the brake device 9 is in the emergency braking state and that the car 1 can be stopped within the allowable stopping distance, the safety determining portion 22 closes the first safety relay 23 and the second safety relay 24 to validate braking force reduction control. Otherwise, the safety determining portion 22 opens the first safety relay 23 and the second safety relay 24 to invalidate braking force reduction control. When it is determined that the car 1 can be stopped within the allowable stopping distance, the safety relays 23 and 24 may be closed again even after having been opened temporarily in the course of braking force reduction control.

The functions of the command generating portion 21 and the safety determining portion 22 are realized by a single microcomputer or a plurality of micro computers. That is, programs for realizing the functions of the command generating portion 21 and the safety determining portion 22 are stored in the single micro computer of the brake control device 19 or in the plurality of the micro computers of the brake control device 19.

Figure 3:
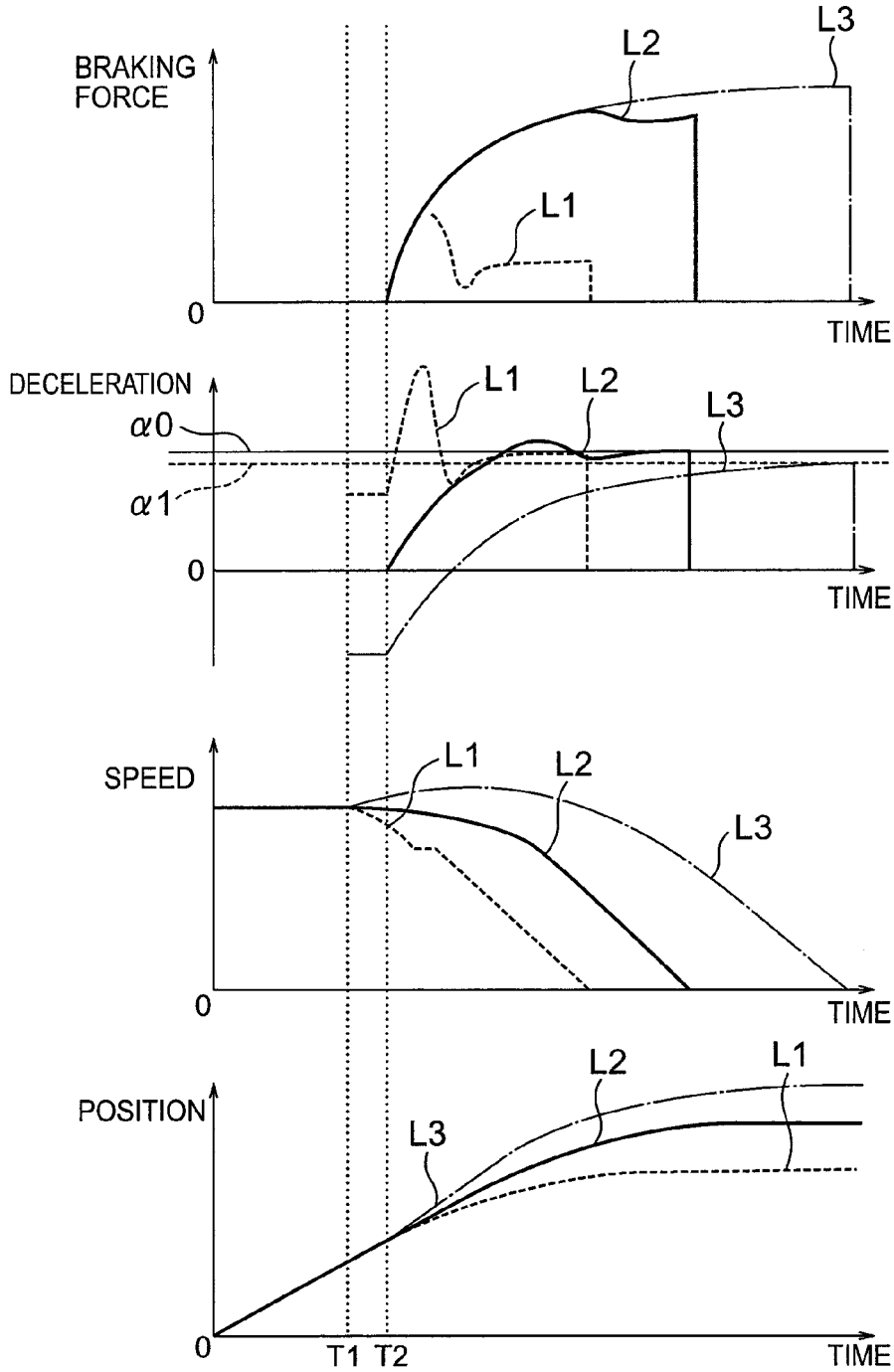
FIG. 3 is composed of graphs showing changes over time in braking force, deceleration, speed, and car position in a case where the brake control device of FIG. 2 performs deceleration control at the time of emergency braking.

FIG. 3 is composed of graphs showing changes over time in braking force, deceleration, speed, and car position in a case where the brake control device 19 of FIG. 2 performs deceleration control at the time of emergency braking. Referring to FIG. 3, broken lines L1 in each of the graphs represent a case where the car 1 carries a light load while traveling downward or a case where the car 1 carries a heavy load while traveling upward. In contradiction to the broken lines L1, alternate long and short dash lines L3 in each of the graphs represent a case where the car 1 carries a heavy load while traveling downward or a case where the car 1 carries a light load while traveling upward. In addition, each of solid lines L2 in the graphs represent a case where the car 1 carries a load somewhere between those of L1 and L3 regardless of the traveling direction thereof while the weight on the car 1 side is balanced with the weight on the counterweight 2 side.

When an emergency stop command is generated at a time instant T1, a braking force is generated at a time instant T2. That is, the supply of a current to the motor 6 is also shut off at the time of emergency braking, so the car 1 is either accelerated (as indicated by alternate long and short dash lines L3) or decelerated (as indicated by broken lines L1) due to an imbalance between the weight on the car 1 side and the weight on the counterweight 2 side until the braking force is actually generated (until brake shoes 10 come into abutment on brake pulley 8) after generation of the emergency stop command.

The elevator apparatus is designed such that the car 1 can be stopped without reaching each of terminal portions of the hoistway even when the distance (stopping distance) to be covered before the stoppage of the car 1 after the start of emergency braking operation is the longest (as indicated by alternate long and short dash lines L3), unless braking force reduction control is performed. Accordingly, even when braking force reduction control is performed in the vicinity of each of terminal floors, the car 1 is prevented from reaching a corresponding one of the terminal portions of the hoistway if the car 1 is stopped at a distance shorter than the longest stopping distance. In this example, the safety determining portion 22 monitors the deceleration of the car 1, determines whether or not the car 1 can be stopped within the allowable stopping distance, and opens/closes the safety relays 23 and 24.

In the case where a determination on the opening/closing of the safety relays 23 and 24 is made on the basis of the deceleration of the car 1, the safety relays 23 and 24 are closed to validate braking force reduction control only when the deceleration of the car 1 is higher than a reference deceleration $\alpha 1$ of FIG. 3. Thus, the deceleration of the car 1 is always held higher than the reference deceleration $\alpha 1$, so the car 1 can be stopped safely.

The reference deceleration $\alpha 1$ needs to be set at least higher than a maximum deceleration in the case where the car 1 is stopped at the longest stopping distance. If the reference deceleration $\alpha 1$ is set lower than the maximum deceleration, a braking force is reduced even when the car 1 is to be stopped at the longest stopping distance, so an event that the car 1 cannot be stopped at the envisaged longest stopping distance may occur. As a matter of course, the reference deceleration $\alpha 1$ is set lower than a target deceleration $\alpha 0$ during braking force reduction control.

More specifically, given that a total reduced inertial mass of the elevator apparatus with respect to the car 1 is denoted by m, that a maximum value of the braking force exerted by the brake device 9 is denoted by F1, and that a maximum acceleration force in the case where the difference in weight between the car 1 side and the counterweight 2 side is the largest is denoted by F2, the reference deceleration $\alpha 1$ is calculated from the following equation.

$$\alpha 1=(F1-F2)/m$$

In the elevator apparatus structured as described above, at the time of emergency braking of the car 1, the brake control device 19 monitors the running state of the car 1 and makes a switchover between the validity and invalidity of braking force reduction control such that the car 1 is stopped within the allowable stopping distance. Therefore, the car 1 can be kept more reliably from reaching each of the terminal portions of the hoistway while being prevented from undergoing an excessively high deceleration at the time of emergency braking.

The brake control device 19 monitors the deceleration of the car 1 as the running state of the car 1, and validates braking force reduction control when the deceleration of the car 1 is higher than the reference deceleration $\alpha 1$. Therefore, the car 1 can be kept more reliably from reaching each of the terminal portions of the hoistway through relatively simple control.

Embodiment 2

Figure 4:
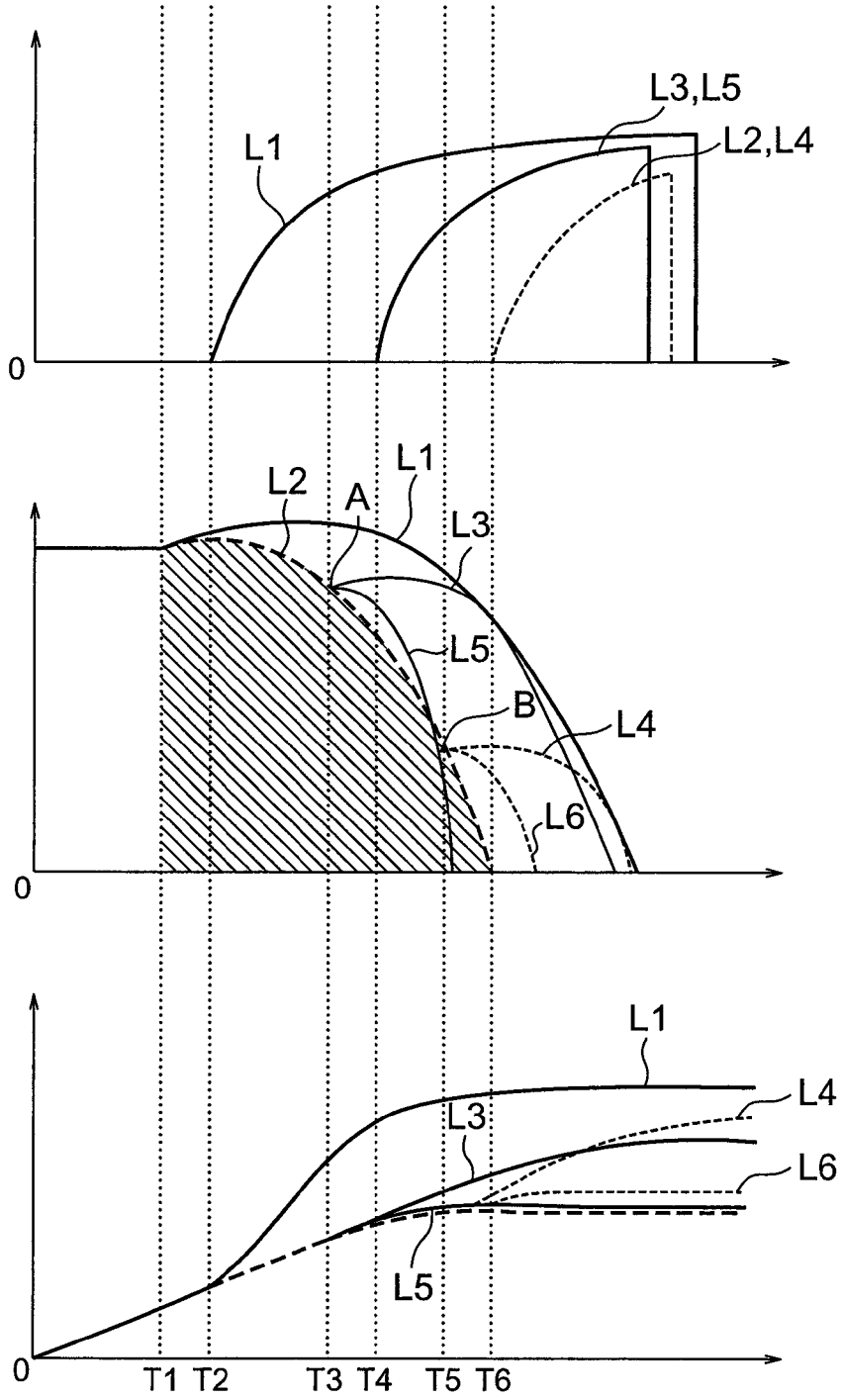
FIG. 4 is composed of graphs showing changes over time in braking force, speed, and car position in a case where a brake control device of an elevator apparatus according to Embodiment 2 of the present invention performs deceleration control at the time of emergency braking.

Reference will be made next to FIG. 4. FIG. 4 is composed of graphs showing changes over time in braking force, speed, and car position in a case where the brake control device 19 of an elevator apparatus according to Embodiment 2 of the present invention performs deceleration control at the time of emergency braking. In Embodiment 2 of the present invention, the brake control device 19 monitors the speed of the car 1 and the time elapsed after generation of an emergency stop command as a running state of the car 1. The brake control device 19 then closes the safety relays 23 and 24 to validate braking force reduction control only when the brake device 9 is in an emergency braking state and the speed of the car 1 shown in FIG. 4 is within an allowable range indicated by a hatched region. Embodiment 2 of the present invention is identical to Embodiment 1 of the present invention in other constructional details and other operational details.

Each of solid lines L1 shown in FIG. 4 indicates changes in a corresponding one of state quantities in the case where the car 1 is stopped at the longest stopping distance. Accordingly, the car 1 can be stopped before reaching each of the terminal portions of the hoistway by being stopped at a distance shorter than the stopping distance corresponding to the solid lines L1.

A borderline of the allowable range for validating braking force reduction control (a reference speed change curve) L2 is a speed change curve in the case where the car 1 is stopped as an emergency measure in a certain load-carrying state without performing braking force reduction control. When the speed of the car 1 exceeds the borderline L2, the safety determining portion 22 opens the safety relays 23 and 24. The speed of the car 1 cannot enter the allowable range indicated by the hatched region, which is lower than the borderline L2, unless the car 1 can be stopped more easily than in that load-carrying state. Accordingly, when the speed of the car 1 exceeds the borderline L2 during the performance of braking force reduction control within the allowable range, a speed curve extending from a point on the borderline L2 according to which the car 1 is stopped at a maximum stopping distance can be calculated on the assumption that the car 1 carries the load by which the borderline L2 is defined.

If the speed of the car 1 reaches the borderline L2 at a point A, the safety relays 23 and 24 are opened at a time instant T3 to invalidate braking force reduction control (a forcible stop command). A braking force is then generated at a time instant T4. In this case, a speed curve is indicated by a solid line L3.

If the speed of the car 1 reaches the borderline L2 at a point B, the safety relays 23 and 24 are opened at a time instant T5 to invalidate braking force reduction control (a forcible stop command). A braking force is then generated at a time instant T6. In this case, a speed curve is indicated by broken lines L4.

In calculating a speed curve as described above according to which the car 1 is stopped at the longest stopping distance, an idle running time before generation of a braking force needs to be taken into account as well. The borderline L2 is set such that a speed curve extending from any point on the borderline L2 remains below the speed curve L1 according to which the car 1 is stopped at the longest stopping distance. By validating braking force reduction control only when the relationship between the speed of the car 1 and time is within the allowable range indicated by the hatched region, the car 1 can be stopped within the allowable stopping distance.

In the elevator apparatus structured as described above, the speed of the car 1 and the time elapsed after generation of an emergency stop command are monitored as the running state of the car 1, and braking force reduction control is validated when the relationship between the speed of the car 1 and the time is within the allowable range. Therefore, the car 1 can be kept more reliably from reaching each of the terminal portions of the hoistway while being prevented from undergoing an excessively high deceleration at the time of emergency braking.

Embodiment 3

Next, Embodiment 3 of the present invention will be described.

In Embodiment 2 of the present invention, the load-carrying state of the car 1 is assumed to be unknown, so the safety relays 23 and 24 are controlled so as to stop the car 1 within the allowable stopping distance even when the relationship between the load-carrying state of the car 1 and the running direction of the car 1 constitutes a condition under which the car 1 is stopped at the longest stopping distance. Thus, when the car 1 can be decelerated easily, the speed curves extending from the points A and B of FIG. 4 are indicated by, for example, a solid line L5 and broken lines L6, respectively, so there is a sufficient margin between each of these speed curves and the solid line L1. Accordingly, the allowable range can be enlarged toward the solid line L1 side if the easiness with which the car 1 is decelerated can be understood.

Figure 5:
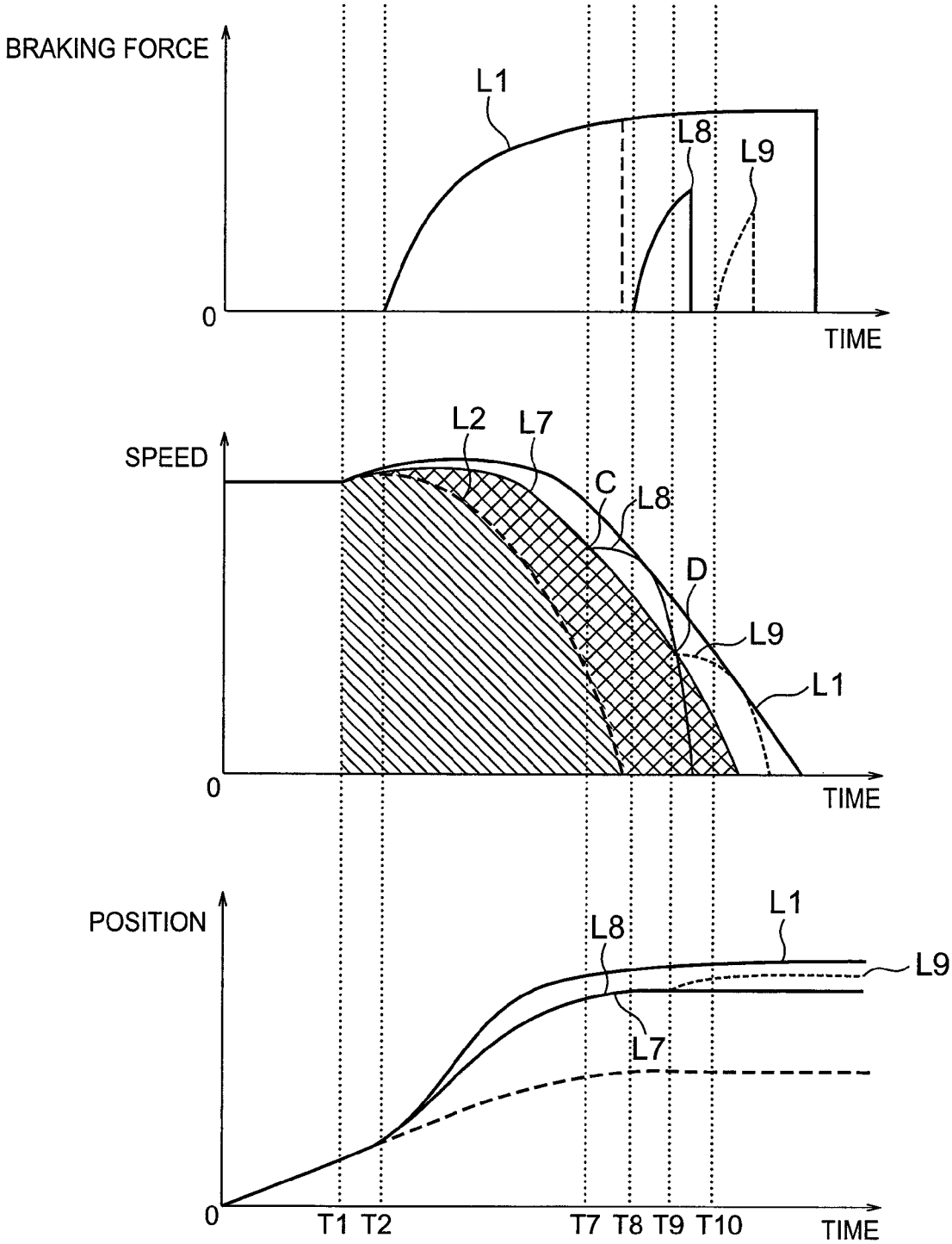
FIG. 5 is composed of graphs showing changes over time in braking force, speed, and car position in a case where a brake control device of an elevator apparatus according to Embodiment 3 of the present invention performs deceleration control at the time of emergency braking.

FIG. 5 is composed of graphs showing changes over time in braking force, speed, and car position in a case where the brake control device 19 of an elevator apparatus according to Embodiment 3 of the present invention performs deceleration control at the time of emergency braking. The safety determining portion 22 determines whether or not the car 1 can be decelerated easily, based on information from a weighing device and a running direction of the car 1. When the car 1 can be decelerated easily, for example, when the car 1 carries a light load while traveling downward or when the car 1 carries a heavy load while traveling upward, the reference speed change curve is changed from the borderline L2 to a borderline L7 to enlarge the allowable range.

If the speed of the car 1 reaches the borderline L7 at a point C, the safety relays 23 and 24 are opened at a time instant T7 to invalidate braking force reduction control (a forcible stop command). A braking force is then generated at a time instant T8. In this case, a speed curve is indicated by a solid line L8.

If the speed of the car 1 reaches the borderline L7 at a point D, the safety relays 23 and 24 are opened at a time instant T9 to invalidate braking force reduction control (a forcible stop command). A braking force is then generated at a time instant T10. In this case, a speed curve is indicated by broken lines L9.

The brake control device 19 closes the safety relays 23 and 24 to validate braking force reduction control only when the brake device 9 is in an emergency braking state and the relationship between the speed of the car 1 and time shown in FIG. 5 is within a range indicated by a hatched region. However, in the case where it is determined that the car 1 can be decelerated easily, the safety relays 23 and 24 are closed to validate braking force reduction control even when the relationship between the speed of the car 1 and time is in a meshed region. Thus, the car 1 can be stopped within the allowable stopping distance. That is, the allowable range is constituted by the meshed region as well as the hatched region.

The borderline L7 is set such that a speed curve extending from any point on the borderline L7 remains below the speed curve L1 according to which the car 1 is stopped at the longest stopping distance in a running state to which the borderline L7 is applied. In other words, when speed change curves are drawn after having determined reference points such as the points C and D at each of the time instants, the borderline L7 can be set as an aggregate of points each corresponding to a maximum speed which are on those speed change curves which always remain below the solid line L1.

In the elevator apparatus structured as described above, the degree of easiness with which the car 1 is decelerated is monitored in addition to the speed of the car 1 and the time elapsed after generation of an emergency stop command, and the allowable range is changed in accordance with the degree of easiness with which the car 1 is decelerated. Therefore, when the car 1 can be decelerated easily, the allowable range of speed and time in which braking force reduction control can be performed can be enlarged.

The aforementioned change in the allowable range may be made either in stages through staged determinations on the degree of easiness with which the car 1 is decelerated or continuously.

Embodiment 4

Figure 6:
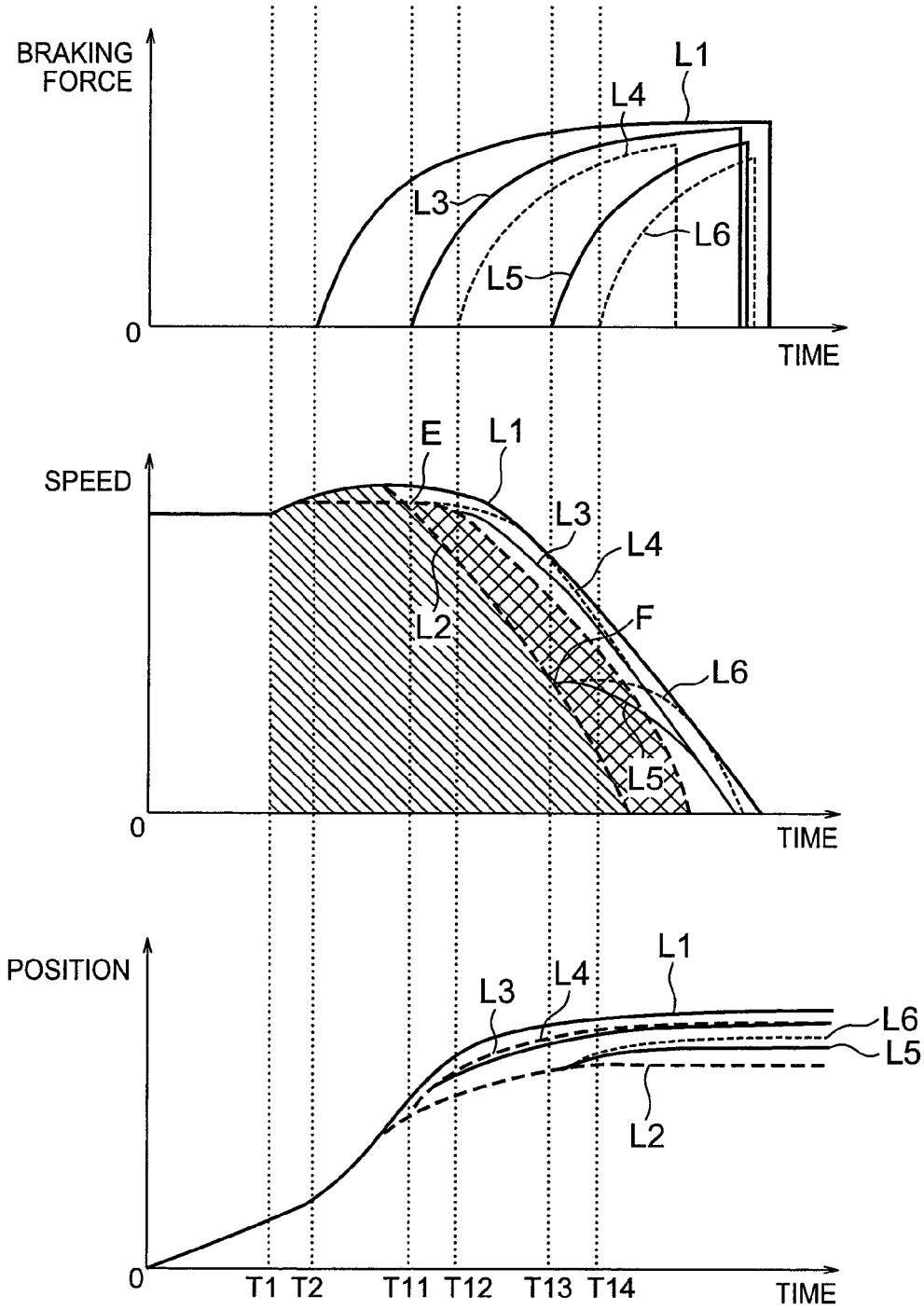
FIG. 6 is composed of graphs showing changes overtime in braking force, speed, and car position in a case where a brake control device of an elevator apparatus according to Embodiment 4 of the present invention performs deceleration control at the time of emergency braking.

Reference will be made next to FIG. 6. FIG. 6 is composed of graphs showing changes over time in braking force, speed, and car position in a case where the brake control device 19 of an elevator apparatus according to Embodiment 4 of the present invention performs deceleration control at the time of emergency braking. The safety determining portion 22 monitors whether or not the car 1 is being decelerated, and closes the safety relays 23 and 24 to validate braking force reduction control only when a logical conjunction of a condition that the car 1 is being decelerated and a condition that the relationship between the speed of the car 1 and time is within an allowable range indicated by a hatched region of FIG. 6 is true.

As described in Embodiment 2 of the present invention, the borderline L2 of the allowable range needs to be set such that the car 1 can be stopped within an allowable stopping distance if the safety relays 23 and 24 are opened when the borderline L2 is exceeded during the performance of braking force reduction control within the allowable range. In Embodiment 4 of the present invention, in the case where the relationship between the speed of the car 1 and time is within the allowable range, a braking force is applied to the car 1 even when the safety relays 23 and 24 are closed if the car 1 is decelerated such that the laden weight of the car 1 and the running direction of the car 1 are related to each other so as to accelerate the car 1. Thus, the idle running time of the car 1 resulting from a brake gap does not need to be taken into account in calculating the longest stopping distance.

On the contrary, when the laden weight of the car 1 and the running direction of the car 1 are related to each other so as to decelerate the car 1, the car 1 may be decelerated with no braking force applied thereto in the idle running time resulting from the brake gap. Therefore, the idle running time of the car 1 needs to be taken into account in calculating the longest stopping distance.

Accordingly, when the safety relays 23 and 24 are opened during deceleration of the car 1 to forcibly stop the car 1, the car 1 may be stopped at the longest stopping distance in the case where the car 1 is stopped without taking an idle running time into account while a force resulting from an imbalance between the weight on the car 1 side and the weight on the counterweight 2 side acts to the utmost in such a direction as to accelerate the car 1, or in the case where the car 1 is stopped without taking the idle running time into account while there is no force resulting from the imbalance.

Referring to FIG. 6, broken lines L4 extending from a point E and broken lines L6 extending from a point F represent speed curves in the case where the car 1 is forcibly stopped without taking the idle running time into account while the force resulting from the imbalance acts to the utmost in such a direction as to accelerate the car 1. According to the broken lines L4, the safety relays 23 and 24 are opened at a time instant T11, and a braking force is generated at a time instant T12. According to the broken lines L6, the safety relays 23 and 24 are opened at a time instant T13, and a braking force is generated at a time instant T14.

In the case where speed curves as mentioned above, according to which the car 1 may be stopped at the longest stopping distance, are drawn while making changes in reference time instant, the borderline L2 is an aggregate of points each corresponding to a maximum reference speed which are on those speed curves which always remain below the solid line L1 at each of the time instants. Accordingly, the car 1 is stopped within the allowable stopping distance by opening the safety relays 23 and 24 to forcibly stop the car 1 when the borderline L2 is exceeded.

In the elevator apparatus structured as described above, the speed of the car 1, the time elapsed after generation of an emergency stop command, and the presence/absence of the state of deceleration of the car 1 are monitored, and braking force reduction control is validated when the logical conjunction of the condition that the car 1 is being decelerated and the condition that the relationship between the speed of the car 1 and time is within the allowable range (indicated by the hatched region of FIG. 6) is true. Therefore, the allowable range of the relationship between speed and time in which braking force reduction control can be performed can be enlarged in comparison with that of Embodiment 2 of the present invention.

By combining the method of control according to Embodiment 3 of the present invention with the method of control according to Embodiment 4 of the present invention, the allowable range of speed and time in which braking force reduction control can be performed can be further enlarged in comparison with that of Embodiment 4 of the present invention. In this case, the degree of easiness with which the car 1 is decelerated is monitored in addition to the items monitored in Embodiment 4 of the present invention. When it is determined that the car 1 can be decelerated easily, the reference speed change curve is shifted toward the solid line L1 side to enlarge the allowable range. Even when the speed of the car 1 is in a meshed region of FIG. 6, the safety relays 23 and 24 are closed to validate braking force reduction control.

Embodiment 5

Next, Embodiment 5 of the present invention will be described. In Embodiment 5 of the present invention, the speed of the car 1 and the position (remaining distance) of the car 1 are monitored as the running state of the car 1.

Figure 7:
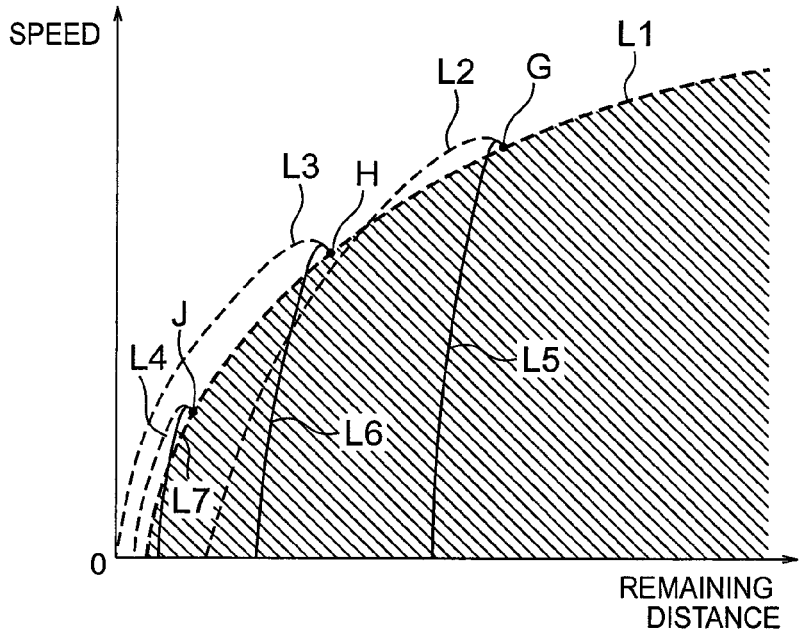
FIG. 7 is a graph showing an example of a condition for validating braking force reduction control in a brake control device of an elevator apparatus according to Embodiment 5 of the present invention.

FIG. 7 is a graph showing an example of a condition for validating braking force reduction control in the brake control device 19 of an elevator apparatus according to Embodiment 5 of the present invention. Referring to FIG. 7, the axis of ordinate represents the speed of the car 1, and the axis of abscissa represents the remaining distance to an allowable stopping position. The safety determining portion 22 closes the safety relays 23 and 24 to validate braking force reduction control only when the relationship between the remaining distance and the speed of the car 1 is within an allowable range indicated by a hatched region of FIG. 7.

Broken lines L2, L3, and L4 of FIG. 7 represent speed curves in the case where the car 1 is forcibly stopped from points G, H, and J, respectively, in a load-carrying state corresponding to the longest stopping distance. A borderline L1 of the allowable range is set such that the speed of the car 1 always becomes 0 before the remaining distance becomes 0 when the car 1 is forcibly stopped from a state corresponding to the borderline L1. That is, the borderline L1 is set as an aggregate of points each corresponding to a maximum speed at which the car 1 can be stopped within the allowable stopping distance with each remaining distance in the load-carrying state corresponding to the longest stopping distance.

In the case where the car 1 is caused to run according to a speed command, the command speed generated by the elevator control device 18 is set such that the speed of the car 1 becomes 0 at a stop floor. Accordingly, it is also possible to estimate a minimum remaining distance to each of the terminal portions of the hoistway from a relationship between changes in command speed over time and the position of the car 1 on the assumption that the stop floor is a corresponding one of the terminal floors, and set the estimated remaining distance as a distance to an allowable stop position. In this case, however, the actual speed of the car 1 is required to follow the command speed appropriately.

On the other hand, a normal elevator apparatus has such a braking performance as can stop the car 1 prior to the arrival thereof at each of the terminal portions of the hoistway even in a load-carrying state corresponding to the longest stopping distance. Therefore, if the longest stopping distance at a speed at the beginning of emergency braking operation is set as a remaining distance at that time instant, the car 1 can be stopped without reaching that terminal portion of the hoistway.

In this case, a remaining distance x0 can be calculated from the following integral equations, using a time t0 required until stoppage of the car 1.

$$Vo + \int_0^{to} m\alpha(t)\,dt = 0 \qquad \text{[Equation 1]}$$

$$Xo = \int_0^{to}\int_0^{to} \frac{F(t)}{m}\,dt\,dt - \frac{F_2 to^2}{2m} \qquad \text{[Equation 2]}$$

The variables and the constants will now be described below. A total reduced inertial mass of the elevator apparatus with respect to the car 1 is denoted by m. An acceleration of the car 1 is denoted by $\alpha(t)$. A braking force exerted by the brake device 9 is denoted by F(t). A maximum acceleration force in the case where there is a maximum difference between the weight on the car 1 side and the weight on the counterweight 2 side is denoted by F2. A speed of the car 1 at the beginning of emergency braking operation is denoted by v0. However, if the brake device 9 is designed to exert a braking force ensuring a certain margin with respect to an allowable stopping distance, a remaining distance having a certain margin with respect to an allowable stop position is calculated.

In the elevator apparatus structured as described above, the speed of the car 1 and the remaining distance to each of the terminal portions of the hoistway or to the allowable stop position are monitored as the running state of the car 1, and braking force reduction control is validated when the relationship between the speed of the car 1 and the remaining distance is within a preset allowable range. Therefore, the car 1 can be kept more reliably from reaching each of the terminal portions of the hoistway while being prevented from undergoing an excessively high deceleration at the time of emergency braking. Further, braking force reduction control can be performed in a larger number of cases.

Embodiment 6

Figure 8:
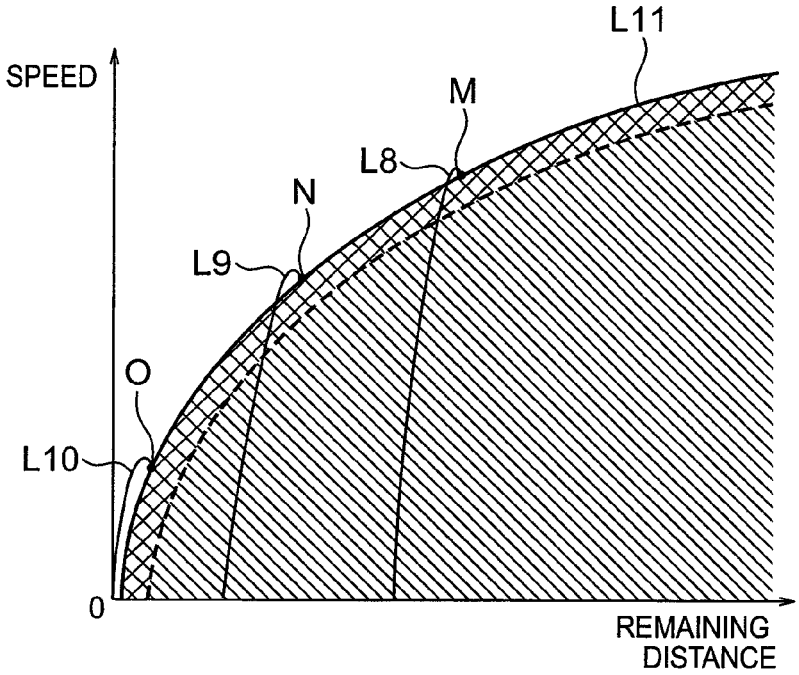
FIG. 8 is a graph showing an example of a condition for validating braking force reduction control in a brake control device of an elevator apparatus according to Embodiment 6 of the present invention.

Reference will be made next to FIG. 8. FIG. 8 is a graph showing an example of a condition for validating braking force reduction control in the brake control device 19 of an elevator apparatus according to Embodiment 6 of the present invention. In this example, as described in Embodiment 3 of the present invention, the degree of easiness with which the car 1 is decelerated is monitored in addition to the items monitored in Embodiment 5 of the present invention. When it is determined that the car 1 can be decelerated easily, the allowable range is enlarged to a meshed region of FIG. 8. Even when the relationship between the speed of the car 1 and the remaining distance is in the meshed region of FIG. 8, the safety relays 23 and 24 are closed to validate braking force reduction control.

A borderline L11 of the allowable range in this case is set as an aggregate of points each corresponding to a maximum speed at which the car 1 can be stopped within an allowable stopping distance with each remaining distance in an understood load-carrying state. Thus, the allowable range of speed and remaining distance in which braking force reduction control can be performed can be further enlarged in comparison with that of Embodiment 5 of the present invention.

In each of the foregoing examples, it is determined based on a signal from the elevator control device 18 whether or not the car 1 is in an emergency braking state. However, the brake control device 19 may independently determine whether or not the car 1 is in the emergency braking state, without resort to the signal from the elevator control device 18. For example, the determination on the emergency braking state of the car 1 may be made by detecting approach of the brake shoes 10 to the brake pulley 8 or contact of the brake shoes 10 with the brake pulley 8. Alternatively, it is possible to determine that the car 1 is in the emergency braking state, when the current value of each of the brake coils 11 is smaller than a predetermined value although the speed of the car 1 is equal to or higher than a predetermined value.

In each of the foregoing examples, the speed of the car 1, the deceleration of the car 1, the position of the car 1, or the like is calculated using a signal from the hoisting machine encoder 12. However, a signal from another sensor such as the speed governor encoder 15, an acceleration sensor mounted on the car 1, or a position sensor mounted on the car 1 may be used instead.

Further, although the safety determining portion 22 is designed to open/close the safety relays 23 and 24 in each of the foregoing examples, a command to generate/stop a command may be transmitted to the command generating portion 21 from the safety determining portion 22.

Still further, the safety determining portion 22 and the command generating portion 21 may be constructed separately from each other.

The invention claimed is:

1. An elevator apparatus, comprising:

a car;

a brake device that brakes a running of the car; and a brake control device that controls the brake device, the brake control device performing braking force reduction control that reduces a braking force of the brake device at a time of emergency braking of the car, wherein the brake control device includes a command generating portion that performs the braking force reduction control at the time of emergency braking of the car, and a safety determining portion that monitors a running state of the car at the time of emergency braking of the car, the brake control device switching between validity and invalidity of the braking force reduction control upon determining that the car can be stopped within a preset allowable stopping distance, the preset allowable stopping distance being a distance between the car and terminal portions of a hoistway within which the car is disposed, and a condition for stopping the car within the preset allowable stopping distance by invalidating braking force reduction control is set in the safety determining portion.

2. The elevator apparatus according to claim 1, wherein the brake control device monitors a speed of the car and a time elapsed after generation of an emergency stop command as the running state of the car, and validates the braking force reduction control when a relationship between the speed of the car and time is within a preset allowable range.

3. The elevator apparatus according to claim 2, wherein the brake control device monitors, based on a laden weight and a running direction of the car, whether or not the car can be decelerated easily as the running state of the car, and changes the allowable range in accordance with a degree of easiness with which the car is decelerated.

4. The elevator apparatus according to claim 1, wherein the brake control device monitors a speed of the car, a time elapsed after generation of an emergency stop command, and whether or not the car is being decelerated, as the running state of the car, and validates the braking force reduction control when a logical conjunction of a condition that the car is being decelerated and a condition that a relationship between the speed of the car and time is within a preset allowable range is true.

5. The elevator apparatus according to claim 4, wherein the brake control device monitors, based on a laden weight and a running direction of the car, whether or not the car can be decelerated easily as the running state of the car, and changes the allowable range in accordance with a degree of easiness with which the car is decelerated.

6. The elevator apparatus according to claim 1, wherein the brake control device monitors a speed of the car and a remaining distance to each of terminal portions of a hoistway as the running state of the car, and validates the braking force reduction control when a relationship between the speed of the car and the remaining distance is within a preset allowable range.

7. The elevator apparatus according to claim 1, wherein the brake control device monitors a speed of the car and a remaining distance to an allowable stopping position of a hoistway as the running state of the car, and validates the braking force reduction control when a relationship between the speed of the car and the remaining distance is within a preset allowable range.

8. The elevator apparatus according to claim 7, wherein the brake control device monitors, based on a laden weight and a running direction of the car, whether or not the car can be decelerated easily as the running state of the car, and changes the allowable range in accordance with a degree of easiness with which the car is decelerated.

9. The elevator apparatus according to claim 1, further comprising a speed detector that generates a signal corresponding to a running speed of the car, wherein the safety determining portion monitors the running state of the car based on the signal from the speed detector at the time of emergency braking.

10. The elevator apparatus according to claim 1, wherein the brake control device includes a safety relay, the opening/closing of the safety relay is controlled by the safety determining portion, and the braking force reduction control performed by the command generating portion is validated through a closure of the safety relay.

11. An elevator apparatus, comprising:

a car;

a brake device that brakes a running of the car; and a brake control device that controls the brake device, the brake control device performing braking force reduction control that reduces a braking force of the brake device at a time of emergency braking of the car, wherein the brake control device includes a command generating portion that performs the braking force reduction control at the time of emergency braking of the car, and a safety determining portion that monitors a running state of the car at the time of emergency braking of the car, the brake control device switching between validity and invalidity of the braking force reduction control upon determining that the car can be stopped within a preset allowable stopping distance, wherein the brake control device monitors a deceleration of the car as the running state of the car, and validates the braking force reduction control when the deceleration of the car is higher than a preset reference deceleration, and wherein a condition for stopping the car within the preset allowable stopping distance by invalidating braking force reduction control is set in the safety determining portion.

12. The elevator apparatus according to claim 11, wherein the preset reference deceleration $\alpha 1$ is calculated by the equation:

$$\alpha 1=(F1-F2)/m,$$

wherein m is a total reduced inertial mass of the elevator apparatus with respect to the car, F1 is a maximum value of the braking force exerted by the brake device, and F2 is a maximum acceleration force in a case where a difference in weight between a car side of the apparatus and a counterweight side opposite the car side is a maximum.

13. The elevator apparatus according to claim 12, wherein the braking force reduction control is validated only when the deceleration of the car is higher than $\alpha 1$.

* * * * *